US005426705A

United States Patent [19]

Yokota et al.

[11] Patent Number: 5,426,705

[45] Date of Patent: Jun. 20, 1995

[54] VEHICLE INTERNAL NOISE REDUCTION SYSTEM

[75] Inventors: Keitaro Yokota, Hoya; Manpei Tamamura; Kazuyuki Kondo, both of Ohta; Hiroshi Iitaka, Koganei, all of Japan

[73] Assignee: Fuji Jukogyo Kabushiki Kaisha, Tokyo, Japan

[21] Appl. No.: 135,463

[22] Filed: Oct. 13, 1993

[30] Foreign Application Priority Data

Nov. 2, 1992 [JP] Japan ..... 4-294474

[51] Int. Cl.[6] ..... G10K 11/16

[52] U.S. Cl. ..... 381/71

[58] Field of Search ..... 381/71, 94

[56] References Cited

U.S. PATENT DOCUMENTS

| | | | |
|---|---|---|---|
| 4,153,815 | 5/1979 | Chaplin et al. | 381/71 |
| 5,018,202 | 5/1991 | Takahashi et al. | 381/71 |
| 5,111,507 | 5/1992 | Nakaji | 381/71 |

OTHER PUBLICATIONS

U.S. application Ser. No. 08/154,074 , filed Nov. 18, 1993, Yokota et al.

U.S. application Ser. No. 08/264,150, filed Jun. 22, 1994, Shibata et al.

U.S. application Ser. No. 08/214,489, filed Mar. 18, 1994, Iidaka et al.

U.S. application Ser. No. 08/234,018, filed Apr. 28, 1994, Tamamura et al.

U.S. application Ser. No. 08/032,057, filed Mar. 16, 1993, Tamamura et al.

U.S. application Ser. No. 08/180,995, filed Jan. 14, 1994, Tamamura et al.

*Primary Examiner*—Forester W. Isen

*Attorney, Agent, or Firm*—Beveridge, DeGrandi, Weilacher & Young

[57] ABSTRACT

In an automobile vehicle, fuel injection pulse outputted from an electronic control unit of an engine is transformed into a voltage value as a primary source. The voltage values is transformed by the convolution sum process and synthesized into a sound to cancel the engine noise. The synthesized sound is outputted through the speaker in the passenger compartment. On the other hand, the reduced noise sound is detected as an error signal by the microphone. The error signal is inputted to an LMS circuit where the filter coefficient is updated in accordance with both inputted error signal and the primary source. Since the fuel injection pulse before the combustion stroke is used, the noise sound can be precisely and immediately reduced even in the transient conditions of the vehicle operation.

3 Claims, 4 Drawing Sheets

VEHICLE INTERNAL NOISE REDUCTION SYSTEM

BACKGROUND OF THE INVENTION

The present invention relates to a noise reduction system for a passenger compartment of an automotive vehicle by positively generating the sound to cancel the vehicle internal noise.

There have been proposed several techniques for reducing the bass sound generated mainly from an engine and transmitted to the passenger compartment by producing canceling sound from an additional sound source such as a speaker disposed in the passenger compartment. The amplitude of the canceling sound is the same as that of the bass sound, but the canceling sound has a reversed phase to that of bass sound.

For example, Japanese patent application laid open No. 1988-315346 discloses a noise reduction technique for reducing the bass sound by detecting the engine speed from the output interval of the ignition signal, retrieving the canceling sound determined at every engine speed range, outputting the canceling sound from a speaker, on the other hand, receiving the bass sound in the passenger compartment from a microphone disposed at a noise receiving position, comparing the bass sound with the previous bass sound, in case of a low (high) level of the inputted bass sound outputting the canceling sound with an advanced (retarded) phase or with a lowered (heightened) amplitude from the speaker, and controlling the canceling sound so as to minimize the input level of the bass sound received from the microphone.

In this prior art technology, however, since the engine speed fluctuates incessantly during the vehicle traveling, and fluctuates violently particularly during a transient engine operation, even if an optimum canceling sound is outputted for each engine speed range, the output waveform of the canceling sound signal becomes discontinuous, so that an uncomfortable noise is produced when the connection timing is put out of order.

To overcome this problem, for example, Japanese patent application laid open No. 1991-90448 proposes a technique to prevent the uncomfortable noise from being generated by providing a so-called waiting time during which the canceling sound is not outputted, whereby a smooth connection of the canceling sound can be made before and after a fluctuation of the engine speed.

However, in this prior art technique for reducing bass sound, when the vehicle is started, since the bass sound can not be reduced positively during a transient engine operation, the bass sound caused by an engine is transmitted directly into the passenger compartment. Also when the vehicle is transferred to a constant speed traveling, the bass sound is substantially eliminated by the canceling sound. In these ways, since sometime the bass sound is eliminated and sometime it is produced, consequently a vehicle driver or a passenger becomes uncomfortable.

SUMMARY OF THE INVENTION

With these problems in mind, therefore, it is a primary object of the present invention to provide a vehicle internal noise reduction system which can effectively reduce the bass noise in the passenger compartment even during the transient operation as well as during the constant speed operation.

A further object of the present invention is to provide a vehicle internal noise reduction system which can reduce the bass sound in the passenger compartment with a low cost and a high reliability without use of any additional vibration sensor.

To achieve the abovementioned objects, the vehicle internal noise reduction system according to the present invention comprises: input signal transforming means responsive to the fuel injection pulse width signal for transforming into a vibration noise source signal with a frequency spectrum composed of predetermined high order components of engine load conditions and for outputting the transformed vibration noise source signal; canceling signal synthesizing means responsive to the outputted vibration noise source signal for synthesizing the transformed vibration noise source signal into a canceling signal and for outputting the synthesized canceling signal; canceling sound generating means responsive to the synthesized canceling signal for generating canceling sound to cancel vibration noise sound in a passenger compartment; error signal detecting means for detecting a noise reduction state at a noise receiving point as an error signal; and coefficients updating means responsive to the detected error signal and the abovementioned vibration noise source signal for updating filter coefficients of the adaptive filter.

Next, based on the composition of means abovementioned, in the vehicle internal noise reduction system according to the present invention, it will be briefly explained how the noise reduction system functions and what effects can be anticipated of the present invention.

First, a fuel injection pulse width signal is detected from the ECU of the engine. Next, by the input signal transforming means, the detected fuel injection pulse width signal is transformed into a vibration noise source signal with a frequency spectrum composed of predetermined high order components of engine lead conditions. Next, by the canceling signal synthesizing means, the vibration noise source signal is synthesized into a canceling signal and, by the canceling sound generating means responsive to the canceling signal, a canceling sound to cancel the vibration noise sound in the passenger compartment is generated from a sound source. Further, by the error signal detecting means, a reduced noise sound is detected as an error signal and then the detected error signal is inputted into the coefficient updating means. Then, by the coefficients updating means responsive to the error signal and the above vibration noise source signal, a filter coefficient of the adaptive filter is updated.

Thus, since the fuel injection pulse signal coming earlier than the start of the combustion stroke is employed as a basic signal for the noise reduction, the noise reduction system according to the present invention has an excellent response to load fluctuations of engine, so that the internal noise can be reduced effectively at a transient operating condition or a high load condition.

DETAILED DESCRIPTION OF THE PREFERRED EMBODIMENTS

The preferred embodiments of the vehicle internal noise reduction system according to the present invention will be described hereinbelow with reference to the attached drawings.

Figure 2:
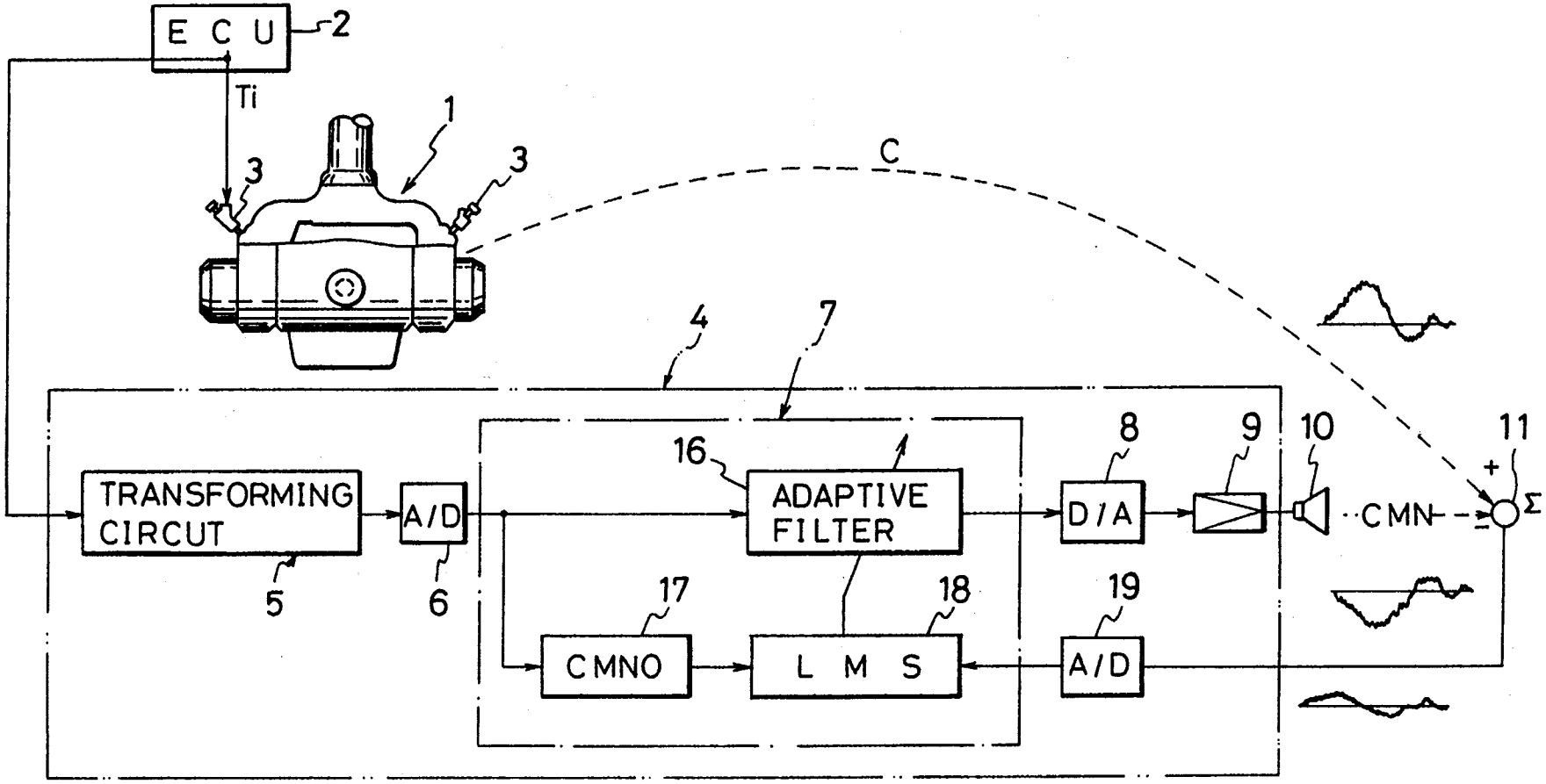
FIG. 2 is a schematic block diagram illustrating the operational principle of an embodiment of the internal noise reduction system according to the present invention.

FIG. 2 is a practical block diagram illustrating the embodiment of the present invention. Reference numeral 1 denotes an engine and numeral 2 is an electronic control unit (ECU) as control means to determine a fuel injection pulse for a fuel injector 3 of the engine 1 based on several kinds of parameters. The injector 3 is disposed in each cylinder of the engine 1 and an appropriate amount of fuel is supplied to each cylinder by a sequential control through the fuel injector 3. A canceling sound generating apparatus 4 is connected to the abovementioned ECU 2. A fuel injection pulse $T_i$ corresponding to a cylinder (for example, #1 cylinder in case where the engine 1 is a four cylinder engine and fuel injection is provided at a cylinder #1, #3, #2 and #4 in this order) is inputted to a transforming circuit 5 of the canceling sound generating apparatus 4. The transforming circuit 5 is connected to an adaptive filter circuit 7 via an A/D converter 6 and the adaptive filter circuit 7 is connected to a speaker 10 which acts as canceling sound generating means via a D/A converter 8 and an amplifier 9. The speaker 10 is disposed in a passenger compartment not shown in this figure. Further, a microphone 11 which acts as error signal detecting means is disposed at a sound receiving position (for instance, a position adjacent to a driver's ear) in the passenger compartment.

Figure 3:
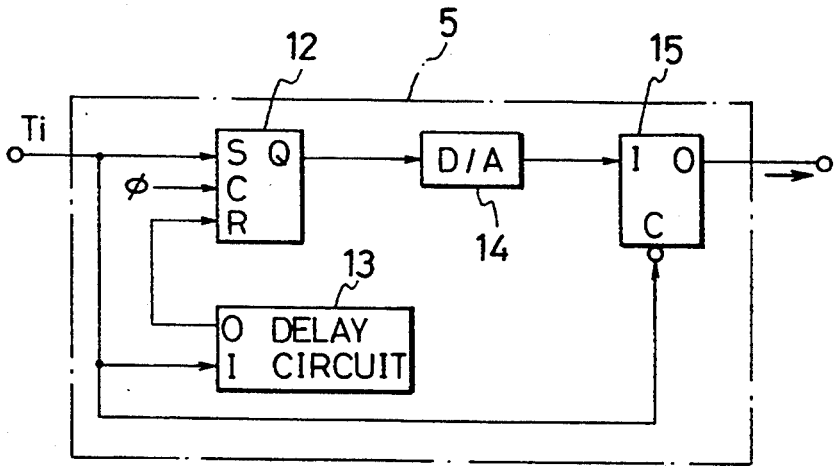
FIG. 3 is an illustration for explaining a fuel injection pulse width signal transforming circuit.

Referring now to FIG. 3, the above transforming circuit 5 comprises a RS flip-flop type counter 12, a delay circuit 13, a D/A converter 14, and an analogue switch 15. A fuel injection pulse $T_i$ is inputted to a set terminal S of the counter 12 from the ECU 2. Further, a reset terminal R is connected with an output terminal O of the above delay circuit 13. Further, a clock pulse $\phi$ is inputted to a count input terminal C. An output terminal Q of the counter 12 is connected to the D/A converter 14. Further, the fuel injection pulse $T_i$ is inputted to an input terminal I of the delay circuit 13. Furthermore, the D/A converter 14 is connected to an input terminal I of the analogue switch 15 and the fuel injection pulse $T_i$ is inputted to a control terminal C of the analogue switch 15. Further, the A/D converter 6 is connected to an output terminal of the analogue switch 15. That is to say, the fuel injection pulse $T_i$ generated from the ECU 2 is inputted to the above transforming circuit 5 and is outputted to the A/D converter 6 after being transformed into a vibration noie source signal (hereinafter referred to as a primary source, too).

Figure 5:
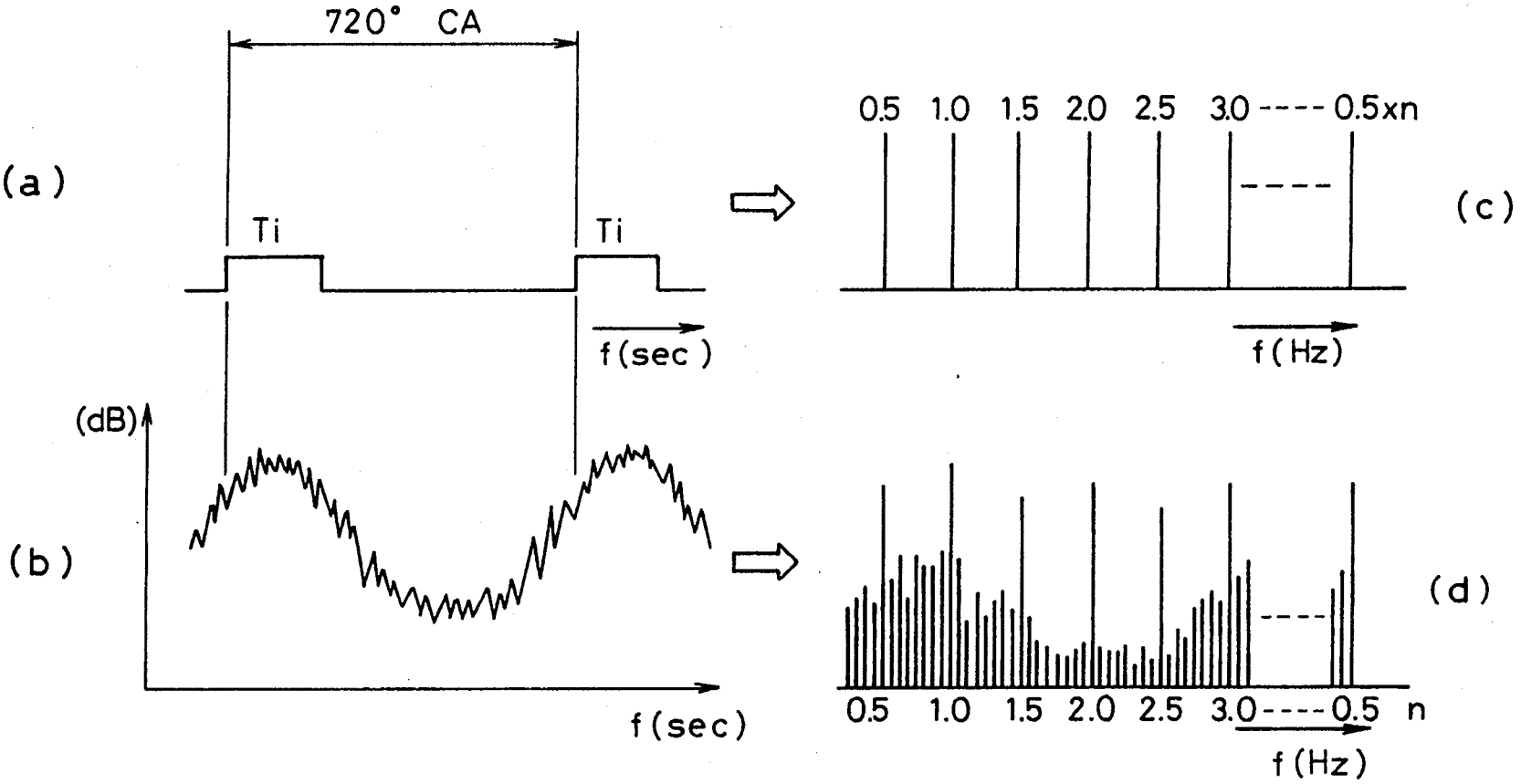
FIG. 5 shows, in views (a) and (b), a correlation illustration showing the relationship between the fuel injection timing and the engine vibration and views (c) and (d) show an analysis chart of frequency components of the engine.

Referring to FIG. 5, the vibration noise of the four strokes engine, as shown in FIG. 5(*b*), is a vibration noise forming one cycle per two engine revolutions because the engine 1 has four strokes (induction, compression, explosion and exhaust) per two engine revolutions, i.e., 720 degrees of crank angle. According to a frequency analysis, as shown in FIG. 5(*d*), the noise frequency spectrum is mainly composed of 0.5 order component per two engine revolutions (one-cycle sine wave component for every two engine revolutions) as a fundamental harmonic wave and higher order components of $0.5 \times n$ (integers). Additionally, it is known that the vibration noise caused by an engine becomes great with an increase of the engine load, namely, a vibromotive force. On the other hand, as indicated in FIG. 5(*a*), in the fuel injection pulse $T_i$ determined optimally based upon various operating conditions, its pulse width contains engine load information and its pulse interval includes engine speed information. The fuel injection pulse signal is outputted before the start of the combustion stroke.

The primary source is inputted to the adaptive filter circuit 7 via the A/D converter 6. The adaptive filter circuit 7 comprises mainly an adaptive type digital filter (hereinafter referred to as an adaptive filter) 16 for synthesizing a canceling signal, a speaker-microphone transmission characteristics correction circuit (hereinafter referred to as a $C_{MNO}$ circuit) 17, and a filter coefficient updating circuit (hereinafter referred to as a LMS circuit, LMS: Least Means Square) 18. The output signal of the primary source from the A/D converter 6 is inputted both to the above adaptive filter 16 and the above $C_{MNO}$ circuit 17. The reduced noise sound detected by the microphone 11 is outputted as an error signal to the above LMS circuit 18 via an A/D converter 19. A filter coefficient updating value is calculated in the LMS circuit 18 based on the error signal outputted from the microphone 11 and the output signal from the $C_{MNO}$ 17 and the filter coefficient updating value is outputted to the above adaptive filter 16. The adaptive filter 16 is a FIR (Finite Impulse Response) filter having filter coefficients $W_{(n)}$ updatable by the LMS circuit 18. In this embodiment, for example, the adaptive filter 16 is provided with 256 taps. Based on the primary source inputted to the adaptive filter 16 and the filter coefficients $W_{(n)}$ updated by the LMS circuit 18, a sum of convolution products of the primary source signal is calculated by the adaptive filter 16 and outputted as a canceling signal therefrom to the D/A converter 8. In the $C_{MNO}$ circuit 17, speaker-microphone transmission characteristics $C_{MN}$ have been predetermined as apploximate values to impulse responses. The primary source signal inputted to the $C_{MNO}$ circuit 17 is multiplied by the speaker-microphone transmission characteristics $C_{MN}$ (a sum of convolution products process) and the primary source signal corrected hereinbefore is outputted to the LMS circuit 18. The LMS circuit 18 is a circuit to produce a filter correction value based on the error signal from the microphone 11 and the signal from the $C_{MNO}$ circuit and to update the filter coefficients $W_{(n)}$ of the adaptive filter so that the error signal received by the microphone 11 can be minimized using the produced filter correction value. In FIG. 2, a symbol C denotes the transmission characteristics of a vehicle body with respect to the vibration noise generated from the engine 1 and a symbol $C_{MN}$ indicates the transmission characteristics between the speaker 10 and the microphone 11.

Figure 1:
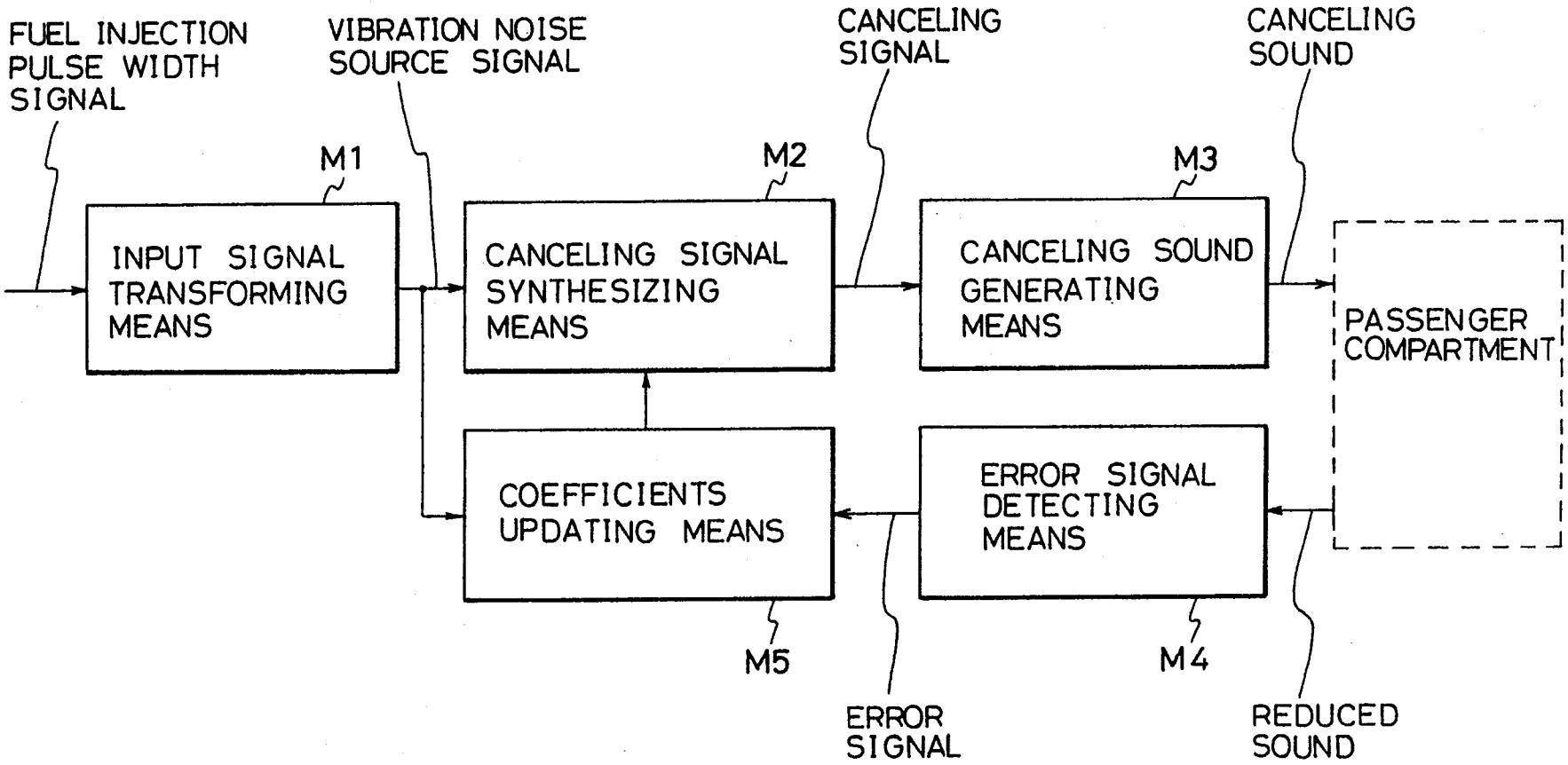
FIG. 1 is a block diagram illustrating the concept of the noise reduction system of the present invention.

Finaly, the concept of the noise reduction system according to the present invention will be explained by referring to FIG. 1 and FIG. 2.

A fuel injection pulse width signal generated from an electronic control unit of an engine is inputted to input signal transforming means M1 (primary component: a transforming circuit 5). The output of the transforming means M1, namely a vibration noise source signal is applied to canceling signal synthesizing means M2 (primary component: an adaptive filter 16). The output of the canceling signal synthesizing means M2, namely a canceling signal is given to canceling sound generating means M3 (primary component: a speaker 10). The canceling sound generating means M3 generates a canceling sound to cancel the noise sound in the passenger compartment. Further, the noise sound canceled by the canceling sound is detected by error signal detecting means M4 (primary component: a microphone 11). The output of the error signal detecting means M4, an error signal and the output of the transforming means M1, the vibration noise source signal are both transmitted to coefficients updating means M5 (primary components: a $C_{MNO}$ circuit 17 and a LMS circuit 18). Further, an output signal of the coefficients updating means M5 is given to the canceling signal synthesizing means M2 to update filter coefficients.

Next, the operation of the embodiment thus constructed will be described.

Engine vibration noise sound is transmitted from an engine 1 into the passenger compartment via an engine mount (not shown) and the transmitted engine vibration noise sound becomes vehicle internal noise sound in the passenger compartment. Induction and exhaust noise sounds are also transmitted into the passenger compartment. The engine related vibration noise sound has a frequency spectrum mainly composed of $0.5\times n$ (integers) order components of the number of the engine revolution as illustrated in FIG. 5. The noise sound multiplied by the vehicle body transmission characteristics C is transmitted to the noise receiving point, for instance, a position nearby a driver's ear.

Figure 4:
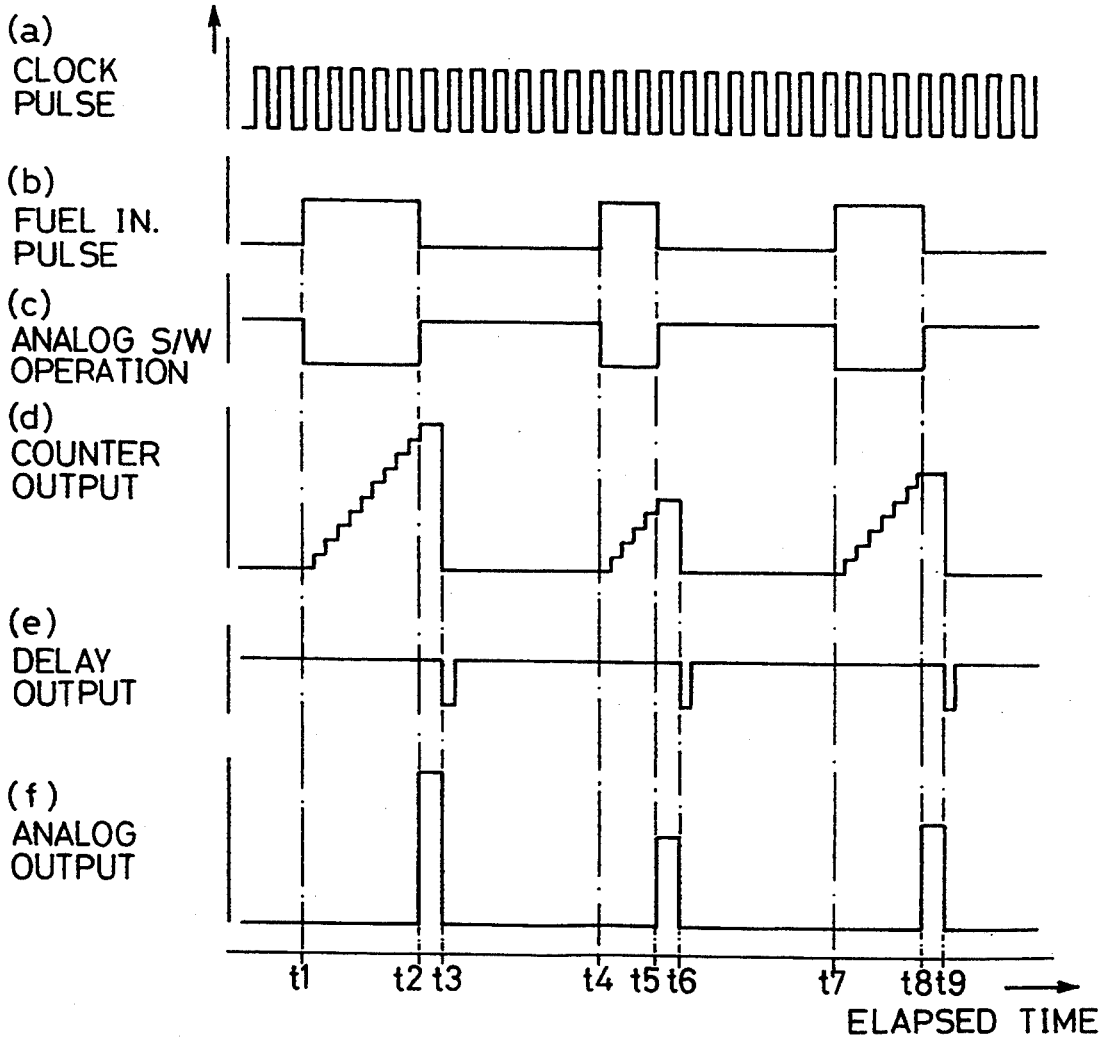
FIG. 4 is a time chart for illustrating an operation of the fuel injection pulse width signal transforming circuit.

On the other hand, when a fuel injection pulse $T_i$ for a specific cylinder is outputted from the ECU 2 with a specified interval, the canceling sound generating apparatus 4 detects the fuel injection pulse signal. This fuel injection pulse $T_i$ is inputted to the set terminal S of the counter 12, the input terminal I of the delay circuit 13 and the control terminal C of the analogue switch 15 in the transforming circuit 5. Then, while the number of the clock pulse is counted by the counter 12, simultaneously the counter output is continued to be increased according to the clock pulse counted by the counter 12 as shown in FIG. 4. Further, on the other hand, immediately when the pulse signal $T_i$ is inputted to the analogue switch 15, the analogue switch 15 is turned off so that the counter output is not outputted outside of the transforming circuit.

After that, when the fuel injection pulse $T_i$ is turned off, the output value from the output terminal Q of the counter 12 is kept constant and simultaneously the analogue switch 15 is turned on, as a result the output value is outputted from the analogue switch 15 to the A/D converter 6 after the output value is converted into the analogue signal by the D/A converter 14.

Furthermore, when a trailing edge of the fuel injection pulse is detected by the delay circuit 13, a reset pulse is outputted to the reset terminal R of the counter 12 with a specified delay time. Then, instantaneously the counter output of the counter 12 becomes 0.

Thus, the fuel injection pulse width (corresponding to the fuel injection amount) is transformed into the analogue output and outputted to the adaptive filter 7 and the $C_{MNO}$ circuit 17 via the A/D converter 6.

Further, in the adaptive filter 16, the process of sum of convolution products is carried out based on the primary source and the filter coeffcients $W_{(n)}$ and then the canceling signal for canceling the vibration noise sound is outputted to the D/A converter 8. This canceling signal is outputted to the speaker 10 via the amplifier 9. The canceling sound outputted from the speaker 10 reaches the sound receiving point after being multiplied by the speaker-microphone transmission characteristics $C_{MN}$. Thus, the engine related vibration noise sound is reduced by interference between the vibration noise sound and the canceling sound and at the same time a result of above interference, namely a reduced noise sound is detected by the microphone 11 disposed at the sound receiving point. The result of interference is transmitted to the LMS circuit 18 of the adaptive filter 7 as an error signal.

On the other hand, the primary source signal inputted to the $C_{MNO}$ circuit 17 is subjected to the process of sum of convolution products based on the predetermined finite impulse response apploximated to the speaker-microphone transmission characteristics and the sum of the products is outputted to the LMS circuit 18. Then, in the LMS circuit 18, a filter correction amount is obtained from the abovementioned error signal and the corrected primary source signal and an algorithm for updating the filter coefficients $W_{(n)}$ of the adaptive filter 16 is executed so that the error signal from the microphone 11 can be minimized.

In this embodiment an example of the noise reduction system, in which a LMS algorithm of one channel (one microphone and one speaker) is employed, has been explained hereinbefore, however this noise reduction system can be applied to a noise reduction system using a MEFX-LMS (Multiple Error Filtered X-LMS) algorithm of multi-channels (for example, four microphones and four speakers).

In summary, the vehicle internal noise reduction system according to the present invention has such excellent effects of the noise reduction in the passenger compartment as, not increasing the number of the components and being able to reduce the internal noise during the transient vehicle operation as well as during the vehicle operation with a constant speed, because the fuel injection pulse signal having a strong correlation with the engine load is employed as a vibration noise source.

While the presently preferred embodiment of the present invention has been shown and described, it is to be understood that this disclosure is for the purpose of illustration and that various changes and modifications may be made without departing from the scope of the invention as set forth in the appended claims.

We claim:

1. An internal noise reduction system for an automobile vehicle having, a compartment for a passenger therein, an internal combustion engine mounted on said vehicle, a fuel injector for injecting fuel into a cylinder of said engine, and an electronic control unit for generating a fuel injection pulse width signal, the system consisting essentially of:

input signal transforming means for transforming said fuel injection pulse width signal into a vibration noise source with a frequency spectrum comprising a plurality of predetermined order components corresponding to engine load and for outputting a vibration noise source signal;

canceling signal synthesizing means responsive to said vibration noise source signal for synthesizing said vibration noise source signal into and for outputting a canceling signal;

canceling sound generating means responsive to said canceling signal for changing into an analog signal and for generating a canceling sound to cancel a vibration noise sound in said compartment;

error signal detecting means responsive to said canceling sound for detecting a reduced noise sound at a noise receiving point as an error signal and for producing an error signal;

coefficient updating means responsive to said error signal and said vibration noise source signal for updating said vibration noise source signal by multiplying said filter coefficients and for transmitting a correction signal; and said canceling signal synthesizing means responsive to said vibration noise source signal and said correction signal for correcting said canceling signal by sum of convolution products of said canceling signal and filter coefficients so as to reduce said noise in said compartment even when said vehicle is in transient driving conditions.

2. The noise reduction system according to claim 1, wherein said canceling sound generating means is at least one speaker disposed in said passenger compartment.

3. The noise reduction system according to claim 1, wherein said error signal detecting means is at least one microphone disposed in said passenger compartment.

* * * * *